US006215977B1

(12) United States Patent
Otani

(10) Patent No.: US 6,215,977 B1
(45) Date of Patent: Apr. 10, 2001

(54) IMAGE FORMING APPARATUS AND METHOD CAPABLE OF PROPERLY PERFORMING STAPLE AND PUNCH OPERATIONS

(75) Inventor: Masaki Otani, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/345,496

(22) Filed: Jul. 1, 1999

(30) Foreign Application Priority Data

Jul. 1, 1998 (JP) ..... 10-186210

(51) Int. Cl.[7] ..... G03G 15/00
(52) U.S. Cl. ..... 399/407; 399/410
(58) Field of Search ..... 399/407, 410, 399/364, 391, 82, 85

(56) References Cited

U.S. PATENT DOCUMENTS 4,763,167 * 8/1988 Watanabe et al. ..... 347/155
5,267,727 * 12/1993 DeHority ..... 270/1.02
5,722,031 * 2/1998 Fujii et al. ..... 399/410
6,029,026 * 2/2000 Natsume et al. ..... 399/82
6,088,568 * 7/2000 Ohtani ..... 399/408

FOREIGN PATENT DOCUMENTS 2-233468 * 9/1990 (JP) .
6-286930 * 10/1994 (JP) .
7-112852 * 5/1995 (JP) .
10-319660 * 12/1998 (JP) .

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus includes sheet supplying mechanisms, an image forming controller, and a sheet ejection mechanism. Each sheet supplying mechanism is capable of storing a stack of recording sheets in one of selective portrait and landscape orientations. The image forming controller reproduces an image according to input image data on a recording sheet, and performs a rotation sort operation which supplies the recording sheets in either the portrait or landscape orientations. The sheet ejection mechanism for ejecting the recording sheet includes a staple mechanism which performs a staple operation for stapling on the recording sheet having the image thereon in one of selective staple patterns and a punch mechanism which performs a punch operation for punching in a trailing edge area of the recording sheet having the image thereon. The image forming controller cancels the rotation sort operation and performs the staple or punch operation when both the rotation sort and staple or punch operations are instructed.

28 Claims, 16 Drawing Sheets

FIG. 8

PORTRAIT SHORT EDGE

| PAPER SIZE \ PATTERN | | No.1 | No.2 | No.3 | No.4 | No.5 | No.6 | No.7 |
|---|---|---|---|---|---|---|---|---|
| | | LEFT TOP SLANTING | RIGHT TOP SLANTING | LEFT TWO | TOP TWO | RIGHT TWO | LEFT TOP HORIZON | RIGHT TOP HORIZON |
| A3R, B4R | SIMPLEX | X1 | 180 | X1 | 180 | X1 | 180 | 180 |
| DLR, LGR | DUPLEX TOP | X1 | 180 | X2 | 180 | X2 | 180 | 180 |
| A4R, B5R | DUPLEX LEFT | X1 | X2 | X1 | X2 | X2 | 180 | X2 |
| LTR, EXR | DUPLEX RIGHT | X2 | 180 | X2 | X2 | X1 | X2 | 180 |
| OTHER THAN ABOVE | | X1 | | | | | | |
| STAPLE PARAMETER | | 0 | 12 | 2 | 14 | 10 | 15 | 13 |
| PUNCH PARAMETER | | | (3) | 0 | 3 | 2 | (3) | (3) |

FIG. 9

LANDSCAPE SHORT EDGE

| PATTERN / PAPER SIZE | | No.1 | No.2 | No.3 | No.4 | No.5 | No.6 | No.7 |
|---|---|---|---|---|---|---|---|---|
| | | LEFT TOP SLANTING | RIGHT TOP SLANTING | LEFT TWO | TOP TWO | RIGHT TWO | LEFT TOP VERTICAL | RIGHT TOP VERTICAL |
| A3R, B4R | SIMPLEX | 0 | X1 | 0 | X1 | 180 | 0 | 180 |
| DLR, LGR | DUPLEX TOP | 0 | X1 | X2 | X1 | X2 | 0 | 180 |
| A4R, B5R | DUPLEX LEFT | 0 | X2 | 0 | X2 | X2 | 0 | X2 |
| LTR, EXR | DUPLEX RIGHT | X2 | X1 | X2 | X2 | 180 | X2 | 180 |
| OTHER THAN ABOVE | | X1 | | | | | | |
| STAPLE PARAMETER | | 0 | 12 | 2 | 14 | 10 | 1 | 11 |
| PUNCH PARAMETER | | (0) | | 0 | 3 | 2 | (0) | (2) |

FIG. 10

PORTRAIT LONG EDGE

| PAPER SIZE \ PATTERN | | No.1 LEFT TOP SLANTING | No.2 RIGHT TOP SLANTING | No.3 LEFT TWO | No.4 TOP TWO | No.5 RIGHT TWO | No.6 LEFT TOP VERTICAL | No.7 RIGHT TOP VERTICAL |
|---|---|---|---|---|---|---|---|---|
| A3, B4, DL, LG | | | | | | | | |
| A4, B5 LT, EX | SIMPLEX | 0 | X1 | 0 | X1 | 180 | 0 | 180 |
| | DUPLEX TOP | 0 | X1 | X2 | X1 | X2 | 0 | 180 |
| | DUPLEX LEFT | 0 | X2 | 0 | X2 | X2 | 0 | X2 |
| | DUPLEX RIGHT | X2 | X1 | X2 | X2 | 180 | X2 | 180 |
| OTHER THAN ABOVE | | X1 | | | | | | |
| STAPLE PARAMETER | | 0 | 12 | 2 | 14 | 10 | 1 | 11 |
| PUNCH PARAMETER | | (0) | | 0 | 3 | 2 | (0) | (3) |

FIG. 11

LANDSCAPE LONG EDGE

| PATTERN / PAPER SIZE | | No.1 ABC LEFT TOP SLANTING | No.2 ABC RIGHT TOP SLANTING | No.3 ABC LEFT TWO | No.4 ABC TOP TWO | No.5 ABC RIGHT TWO | No.6 ABC LEFT TOP HORIZON | No.7 ABC RIGHT TOP HORIZON |
|---|---|---|---|---|---|---|---|---|
| A3, B4, DL, LG | | | | | | | | |
| A4, B5 LT, EX | SIMPLEX | X1 | 180 | X1 | 180 | X1 | 180 | 180 |
| | DUPLEX TOP | X1 | 180 | X2 | 180 | X2 | 180 | 180 |
| | DUPLEX LEFT | X1 | X2 | X1 | X2 | X2 | 180 | X2 |
| | DUPLEX RIGHT | X2 | 180 | X2 | X2 | X1 | X2 | 180 |
| OTHER THAN ABOVE | | X1 | | | | | | |
| STAPLE PARAMETER | | 0 | 12 | 2 | 14 | 10 | 15 | 13 |
| PUNCH PARAMETER | | | 3 | 0 | 3 | 2 | 3 | 3 |

FIG. 13

PORTRAIT SHORT EDGE

| PATTERN / PAPER SIZE | | No.1 | No.2 | No.3 | No.4 | No.5 | No.6 | No.7 |
|---|---|---|---|---|---|---|---|---|
| | | ABC | ABC | ABC | ABC | ABC | ABC | ABC |
| | | LEFT TOP SLANTING | RIGHT TOP SLANTING | LEFT TWO | TOP TWO | RIGHT TWO | LEFT TOP HORIZON | RIGHT TOP HORIZON |
| A3R, B4R | SIMPLEX | X1 | 180 | X1 | 180 | X1 | 180 | 180 |
| DLR, LGR | DUPLEX TOP | X1 | 180 | X1 | 180 | X1 | 180 | 180 |
| A4R, B5R | DUPLEX LEFT | X1 | X2 | X1 | X2 | X1 | 180 | LEFT HORIZON |
| LTR, EXR | DUPLEX RIGHT | X1 | 180 | X1 | X2 | X1 | LEFT HORIZON | 180 |
| OTHER THAN ABOVE | | X1 | | | | | | |
| STAPLE PARAMETER | | 0 | 12 | 2 | 14 | 10 | 15 | 13 |
| PUNCH PARAMETER | | | (3) | 0 | 3 | 2 | (3) | (3) |

FIG. 14

LANDSCAPE SHORT EDGE

| PATTERN / PAPER SIZE | | No.1 | No.2 | No.3 | No.4 | No.5 | No.6 | No.7 |
|---|---|---|---|---|---|---|---|---|
| | | ABC | ABC | ABC | ABC | ABC | ABC | ABC |
| | | LEFT TOP SLANTING | RIGHT TOP SLANTING | LEFT TWO | TOP TWO | RIGHT TWO | LEFT TOP VERTICAL | RIGHT TOP VERTICAL |
| A3R, B4R | SIMPLEX | 0 | X1 | 0 | X1 | 180 | 0 | 180 |
| DLR, LGR | DUPLEX TOP | 0 | X1 | X2 | X1 | X2 | 0 | 180 |
| A4R, B5R | DUPLEX LEFT | 0 | x1 | 0 | X1 | 0 LEFT TWO | 0 | LEFT VERTICAL |
| LTR, EXR | DUPLEX RIGHT | X2 | X1 | 180 RIGHT TWO | X1 | 180 | RIGHT VERTICAL | 180 |
| OTHER THAN ABOVE | | X1 | | | | | | |
| STAPLE PARAMETER | | 0 | 12 | 2 | 14 | 10 | 1 | 11 |
| PUNCH PARAMETER | | (0) | | 0 | 3 | 2 | (0) | (2) |

FIG. 15

PORTRAIT LONG EDGE

| PATTERN / PAPER SIZE | | No.1 ABC LEFT TOP SLANTING | No.2 ABC RIGHT TOP SLANTING | No.3 ABC LEFT TWO | No.4 ABC TOP TWO | No.5 ABC RIGHT TWO | No.6 ABC LEFT TOP VERTICAL | No.7 ABC RIGHT TOP VERTICAL |
|---|---|---|---|---|---|---|---|---|
| A3, B4, DL, LG | | | | | | | | |
| A4, B5 LT, EX | SIMPLEX | 0 | X1 | 0 | X1 | 180 | 0 | 180 |
| | DUPLEX TOP | 0 | X1 | X2 | X1 | X2 | 0 | 180 |
| | DUPLEX LEFT | 0 | X1 | 0 | X1 | 0 LEFT TWO | 0 | LEFT VERTICAL |
| | DUPLEX RIGHT | X2 | X1 | 180 RIGHT TWO | X1 | 180 | RIGHT VERTICAL | 180 |
| OTHER THAN ABOVE | | X1 | | | | | | |
| STAPLE PARAMETER | | 0 | 12 | 2 | 14 | 10 | 1 | 11 |
| PUNCH PARAMETER | | (0) | | | 3 | 2(2) | (0) | (3) |

FIG. 16

LANDSCAPE LONG EDGE

| PAPER SIZE \ PATTERN | | No.1 ABC LEFT TOP SLANTING | No.2 ABC RIGHT TOP SLANTING | No.3 ABC LEFT TWO | No.4 ABC TOP TWO | No.5 ABC RIGHT TWO | No.6 ABC LEFT TOP HORIZON | No.7 ABC RIGHT TOP HORIZON |
|---|---|---|---|---|---|---|---|---|
| A3, B4, DL, LG | | X1 | 180 | X1 | 180 | X1 | 180 | 180 |
| A4, B5 LT, EX | SIMPLEX TOP | X1 | 180 | X1 | 180 | X1 | 180 | 180 |
| | SIMPLEX LEFT | X1 | X2 | X1 | X2 | X1 | 180 | LEFT HORIZON |
| | SIMPLEX RIGHT | X1 | 180 | X1 | X2 | X1 | RIGHT TOP HORIZON | 180 |
| OTHER THAN ABOVE | | | | | X1 | | | |
| STAPLE PARAMETER | | 0 | 12 | 2 | 14 | 10 | 15 | 13 |
| PUNCH PARAMETER | | | 3 | 0 | 3 | 2 | 3 | 3 |

IMAGE FORMING APPARATUS AND METHOD CAPABLE OF PROPERLY PERFORMING STAPLE AND PUNCH OPERATIONS

BACKGROUND OF THE INVENTION

1. Field of the Invention

This invention relates to an image forming apparatus and method, and more particularly to an image forming apparatus and method which can properly perform staple and punch operations in accordance with statuses of recording sheets associated with image orientations.

2. Discussion of the Background

There have been provided image forming apparatuses such as digital copying machines, printers, and so on, having finish operations such as staple and punch operations, for example. For example, Japanese Laid-Open Patent Publication No. JPAP09-261415 (1997) describes an image forming apparatus in which a staple function can be used to staple a stack of recording sheets which have undergone an image forming operation in a variety of staple patterns such as one or two positions on a top side edge, a bottom side edge, a left side edge, a right side edge or a corner of a recording sheet. This image forming apparatus judges a direction of a character string of a print image to perform an appropriate rotation so as to conduct a staple operation on the recording sheets which are sorted in a specific direction.

When a user attempts to print a document prepared on a host computer, the user generally gives a print command without knowing what sheet size and in which sheet orientation the sheet tray of the printer has recording sheets, particularly in network environments in which printers are often located beyond the view of the users. In such a situation, if the user sends a print command with staple and punch commands from a terminal computer to a network printer which can perform finish operations such as staple and punch operations, the network printer performs operations as instructed. As a result, the network printer may staple in a way different from what the user desired.

SUMMARY OF THE INVENTION

Accordingly, an object of the present invention is to provide a novel image forming apparatus which can properly perform staple and punch operations in accordance with statuses of recording sheets associated with image orientations.

To achieve this and other objects, a novel image forming apparatus includes an image forming controller and a sheet ejection mechanism. A plurality of sheet supplying mechanisms store and supply recording sheets. Each sheet supplying mechanism stores a stack of recording sheets in a specific orientation when the recording sheets have a size greater than a predetermined size and in one of selected portrait and landscape orientations relative to a sheet flowing direction when the recording sheets have a size smaller than the predetermined size. The image forming controller reproduces an image according to input image data on a recording sheet supplied from one of the plurality of sheet supplying mechanisms. Also, the image forming controller performs a rotation sort operation which repeats reproduction of an image according to input image data on recording sheets supplied in either the portrait and landscape orientations. The sheet ejection mechanism provides finish operations including staple and punch operations on a recording sheet and ejects the recording sheet outside the image forming apparatus after the image forming controller reproduces an image on the recording sheet. The sheet ejection mechanism includes a staple mechanism which performs the staple operation for stapling on the recording sheet having the image thereon in one of selective staple patterns, and a punch mechanism which performs the punch operation for punching in a trailing edge area of the recording sheet having the image thereon. In the above-described image forming apparatus, the image forming controller cancels the rotation sort operation and performs the staple operation when both the rotation sort and staple operations are instructed.

The selective patterns may include a corner slanting staple, a top side edge staple, a bottom side edge staple, a left side edge staple, and a right side edge staple.

The image forming controller may cancel the rotation sort operation and performs the punch operation when both the rotation sort and punch operations are instructed.

The image forming controller may perform the rotation sort operation only in a case that the staple or punch operation is cancelled, when one of the staple and punch operations and the rotation sort operation are instructed.

The image forming controller may reselect, out of the selective patterns, a pattern appropriate for a staple mode of duplex reproduction and performs the staple operation using the reselected staple pattern, when specified staple patterns for the staple operation and the staple mode of duplex reproduction cause a conflict in positions.

The image forming controller may reselect a punch pattern appropriate for a staple mode of duplex reproduction and performs the punch operation using the reselected punch pattern, when a specified staple pattern for the staple mode of duplex reproduction and a specified punch pattern for the punch operation cause a conflict in positions.

The image forming controller may reselect a punch pattern appropriate for a specified staple pattern for the staple operation and performs the staple operation using the specified staple pattern and the punch operation using the reselected punch pattern, when a specified staple pattern for the staple operation and a specified punch pattern for the punch operation cause a conflict in positions.

According to another feature of the invention there is provided a sheet ejection mechanism in an image forming apparatus which can record images on recording sheets in one of selected portrait and landscape orientations, comprising a staple mechanism which can perform a staple operation in one of selected staple patterns on said recording sheet having an image recorded thereon; a punch mechanism which can perform a punch operation in one of selected punch patterns on said recording sheet having an image recorded thereon; and an image forming controller which controls a reproduction of the image on said recording sheet, a rotation sort operation in which recording sheets are alternately supplied in the portrait and landscape orientations, and staple and punch operations, according to instructed data, wherein said image forming controller cancels said rotation sort operation and performs said staple operation when both said rotation sort and staple operations are instructed.

According to another feature of the invention there is provided an image forming apparatus which can record images on recording sheets in one of selected portrait and landscape orientations, comprising sheet supplying means for storing and supplying recording sheets in one of portrait and landscape orientations; staple means for performing a staple operation in one of selected staple patterns on said recording sheet having an image recorded thereon; punch means for performing a punch operation in one of selected punch patterns on said recording sheet having an image recorded thereon; and image forming control means for controlling a reproduction of the image on said recording sheet, a rotation sort operation in which recording sheets are alternately supplied from said sheet supplying mechanisms in the portrait and landscape orientations, and staple and punch operations, according to instructed data, wherein said image forming control means cancels said rotation sort operation and performs said staple operation when both said rotation sort and staple operations are instructed.

According to another feature of the invention there is provided an image forming method in a recording apparatus having a controller which instructs finishing steps on recording sheets having images recorded thereon, comprising the steps of recording images on the recording sheets; a rotation sort operation which alternately rotates an orientation of the recording sheet having the image recorded thereon between a portrait orientation and a landscape orientation; a staple operation which performs stapling in one of selected staple patterns on said recording sheet having an image recorded thereon; and a punch operation which performs a punch in one of selected punch patterns on said recording sheet having an image recorded thereon, wherein said rotation sort operation is cancelled and said staple operation is performed when both said rotation sort and staple operations are instructed.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 8 through 11 are reference tables for explaining finish operations with respect to respective combinations of the staple patterns and various image orientation factors to be used in the image forming apparatus of FIG. 1;

FIGS. 13 through 16 are modified reference tables for explaining different finish operations with respect to respective combinations of the staple patterns and various image orientation factors to be used in the image forming apparatus of FIG. 1.

DESCRIPTION OF THE PREFERRED EMBODIMENTS

Figure 1:
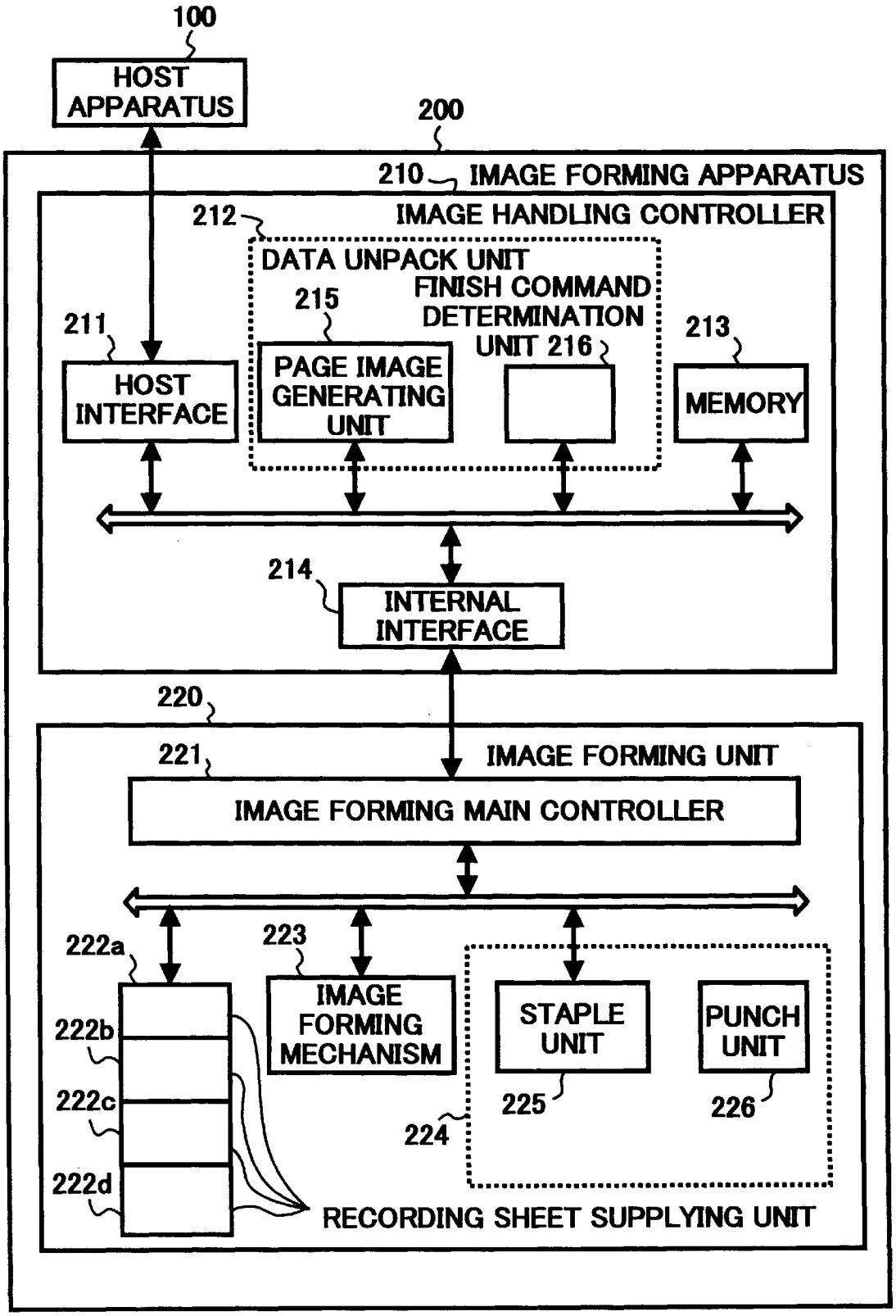
FIG. 1 is a block diagram of an image forming apparatus according to an exemplary embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated a block diagram of an image forming apparatus, e.g., a laser printer, according to an exemplary embodiment of the present invention. As shown in FIG. 1, an image forming apparatus 200 which is capable of reproducing a print image based on image data sent from a host apparatus 100 includes an image handling controller 210 and an image forming unit 220. The image handling controller 210 includes a host interface 211 which communicates with the host apparatus 100 with respect to image data and various commands associated with the image data, an data unpack unit 212, a memory 213, and an internal interface 214.

The data unpack unit 212 includes a page image generating unit 215 and a finish command determination unit 216. The page image generating unit 215 interprets the image data received from the host apparatus 100 and generates data for a print image. The finish command determination unit 216 interprets the commands received from the host apparatus 100 and checks if the received commands include a staple command, a punch command, and/or a rotation sort command in combination. Based on this check, the finish command determination unit 216 determines and instructs performing the functions of a staple, a punch, and/or a rotation sort in response to the staple command, the punch command, and/or the rotation sort command, respectively. The memory 213 stores data that represents correct combinations of patterns (explained later) for the staple and punch functions relative to all possible combinations. The internal interface 214 sends the print image data to the image forming unit 220 and communicates with the image forming unit 220 with respect to print image data and various commands associated with the print image data.

The image forming unit 220 includes an image forming main controller 221, a plurality of recording sheet supply units 222*a*–222*d*, an image forming mechanism 223, and a sheet ejection unit 224. The image forming main controller 221 controls an image forming operation of the image forming mechanism 223, recording sheet supply operations of the recording sheet supply units 222*a*–222*d* and an sheet ejection operation of the sheet ejection unit 224, based on the instructions received from the image handling controller 210. A paper tray of each of the recording sheet supply units 222*a*–222*d* is configured to store the recording sheet smaller than a standard A4 size, for example, in either landscape and portrait orientations. The image forming mechanism 223 reproduces the print image data onto the recording sheets sent from the respective recording sheet supply units 222*a*–222*d*, and has a rotation sort function for switching the orientation of the print image page by page (or set by set) so as to alternately reproduce the print image data onto the landscape or portrait recording sheets of the standard A4 size, for example.

The sheet ejection unit 224 includes a staple unit 225 and a punch unit 226. The staple unit 225 staples in at least one position on the recording sheets which have been processed through the image forming operation performed by the image forming mechanism 223. The punch unit 226 punches a hole in a trailing edge area in the recording sheets which have been processed through the image forming operation performed by the image forming mechanism 223.

Figure 2:
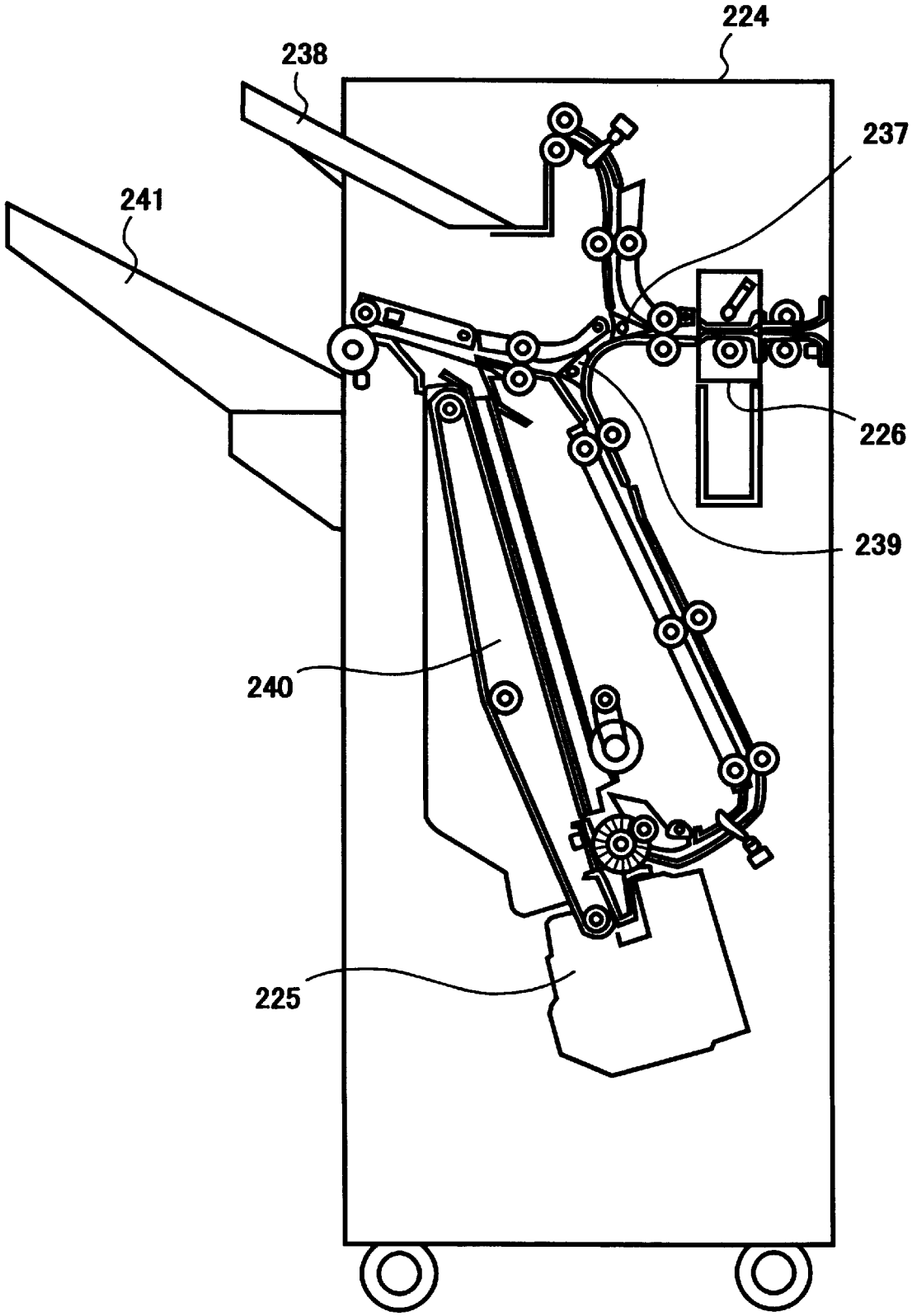
FIG. 2 illustrates a front view of a sheet ejection unit in an exemplary printer incorporating the invention.

An exemplary structure of the sheet ejection unit 224 is illustrated in FIG. 2. The sheet ejection unit 224 of FIG. 2 includes, in addition to the staple unit 225 and the punch unit 226, a tray switch 237, a proof tray 238, a staple selector 239, a staple transfer mechanism 240, and a finishing tray 241. The tray switch 237 is positioned after the punch unit 226 in the direction of paper movement, and selects the paper path to either the proof tray 238 or to the staple selector 239. The staple selector 239 is positioned after the tray switch 237 in the direction of paper movement. The staple selector 239 receives the recording sheet transferred via the tray switch 237 when the tray switch 237 selects the paper path to the staple selector 239, and selects the paper path to either the finishing tray 241 or to the staple transfer mechanism 240. When the staple selector 239 selects the paper path to the finishing tray 241, the recording sheet is forwarded straight to the finishing tray 241. When the staple selector 239 selects the paper path to the staple transfer mechanism 240, the recording sheet is directed down to the staple unit 225 and is held by the staple transfer mechanism 240. When an appropriate set of the recording sheets is thus held by the staple transfer mechanism 240, it is stapled by the staple unit 225. After being stapled, the set of the recording sheets is transferred upwards by the staple transfer mechanism 240 and is ejected to the finishing tray 241.

Figure 3A:
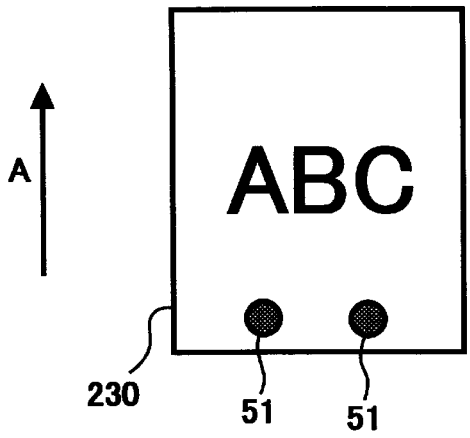
FIGS. 3A through 3D illustrate some possible orientations of punch holes on a sheet which has finish operations performed on it.
Figure 3B:
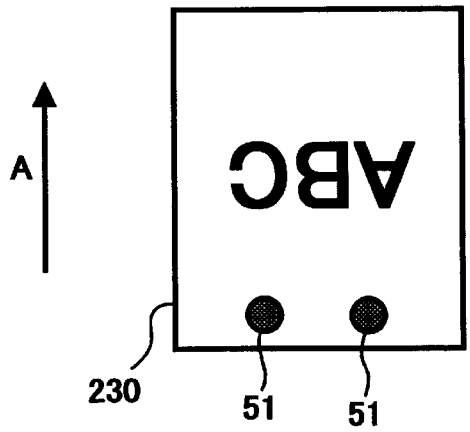
Figure 3C:
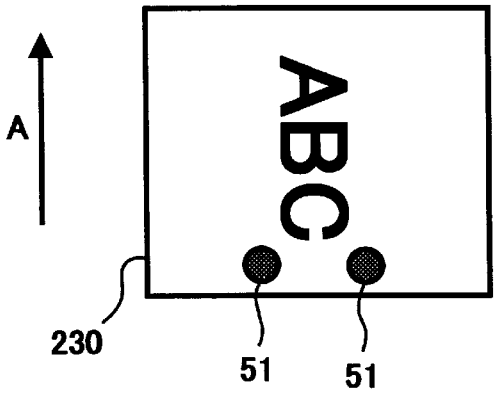
Figure 3D:
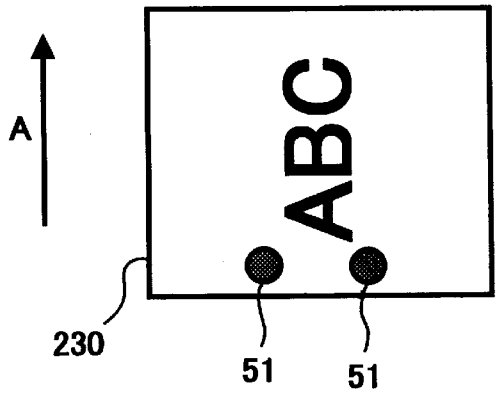
Figure 4:
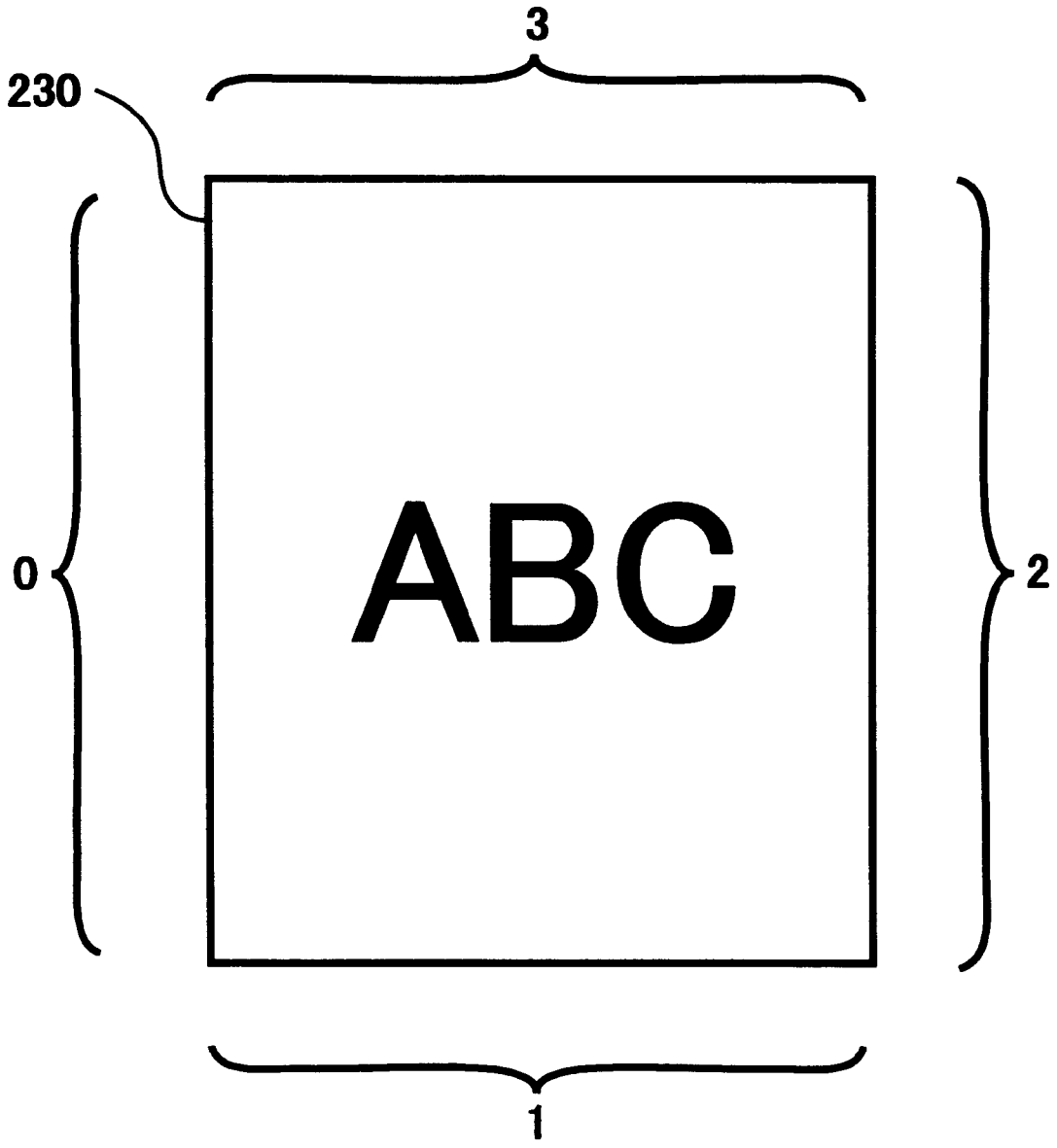
FIG. 4 is an illustration of a recording sheet having an exemplary print ABC for explaining a variety of staple patterns used by the image forming apparatus of FIG. 1.

In this sheet ejection unit 224, the punch function can be first performed on the transferred recording sheet by the punch unit 226. The punch unit 226 is located on the paper path so as to provide the punch holes 51 in the trailing edge of the recording sheets. FIGS. 3A–3D illustrate four selective positions of punch holes 51 relative to the four sides of a recording sheet 230. For example, the recording sheet 230, having a print of letters ABC in the format as shown in FIG. 3A and transferred in the direction as indicated by an arrow A in FIG. 3A is punched with the holes 51 in its bottom short side. When the punch holes 51 need to be made in the top short side of the recording sheet 230, the recording sheet 230 is required to be printed with the image rotated by 180 degrees, as shown in FIG. 3B. For another example, the recording sheet 230 having a print of letters ABC in the format as shown in FIG. 3C and transferred in the direction as indicated by the arrow A in FIG. 3C is punched with the holes 51 in its right longitudinal side. When the punch holes 51 need to be made in the left longitudinal side of the recording sheet 230, the recording sheet 230 is required to be printed with the image rotated by 180 degrees, as shown in FIG. 3D. In the present embodiment, the punch positions are defined with numbers 0–3 as punch position parameter values, as shown in FIG. 4.

Figure 5:
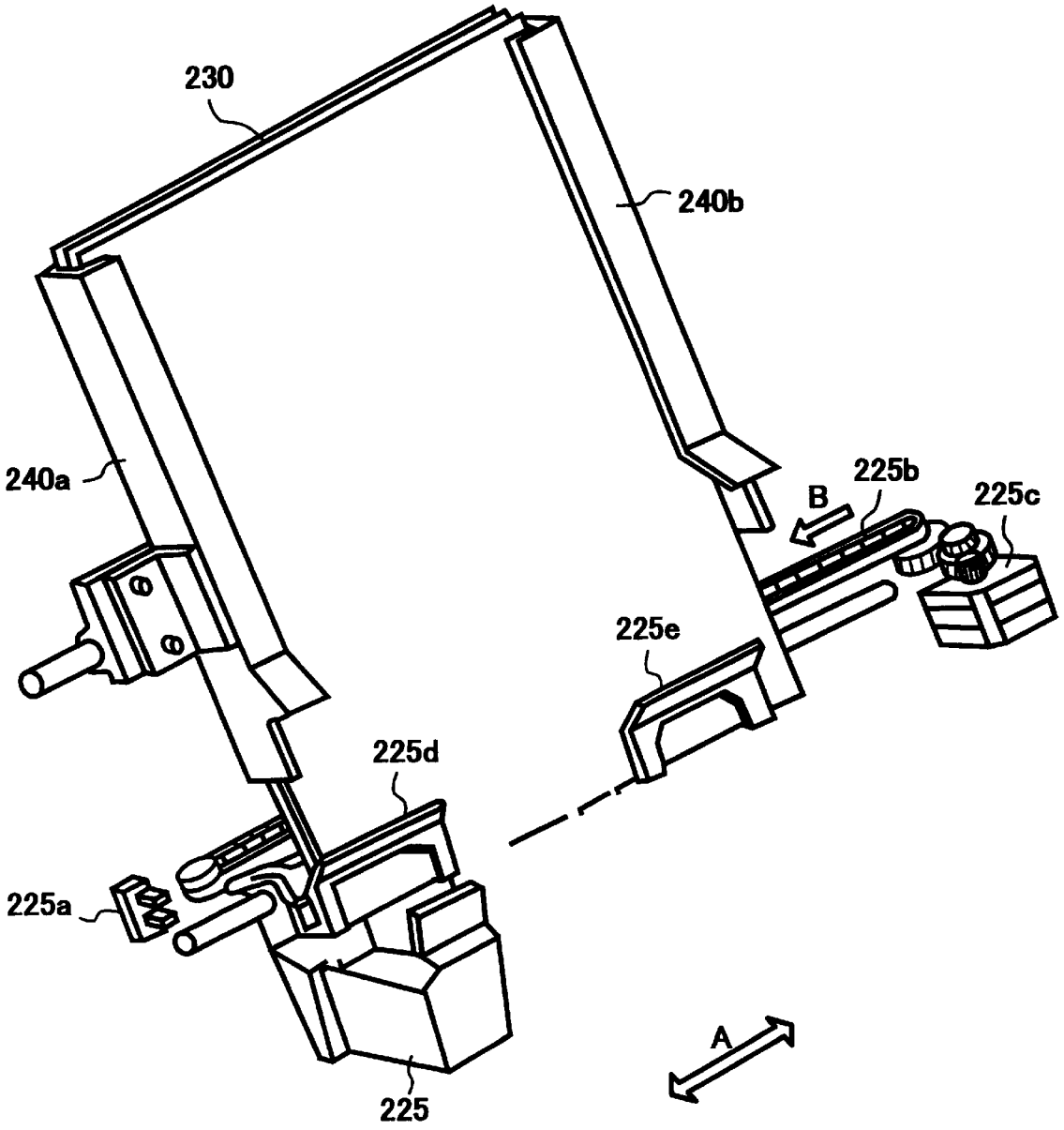
FIG. 5 shows the staple unit of the printer of FIG. 2.

An exemplary configuration of the staple unit 225 and its associated components in the sheet ejection unit 224 is illustrated in FIG. 5. The staple unit 225 includes a home position detector 225*a*, a pinion driven belt 225*b*, a driving motor 225*c*, a staple bracket 225*d*, and another staple bracket 225*e*. With this configuration, the driving motor 225*c* drives the belt 225*b* in a direction B to move the staple unit 225 to its home position using the home position detector 225*a*. Accordingly, the staple unit 225 can be moved in the direction A so as to be positioned at predetermined stapling positions. The set of the recording sheets 230 is held by a pair of holders 240*a* and 240*b*, as shown in FIG. 5. At this time, the recording sheets 230 are placed face down and top side down, that is, the print of letters ABC faces downwards and upside down. Accordingly, the staple unit 225 shoots staples in the top side of the image so that the tips of the staples come out on the top and back side of the recording sheets 230.

Figure 6A:
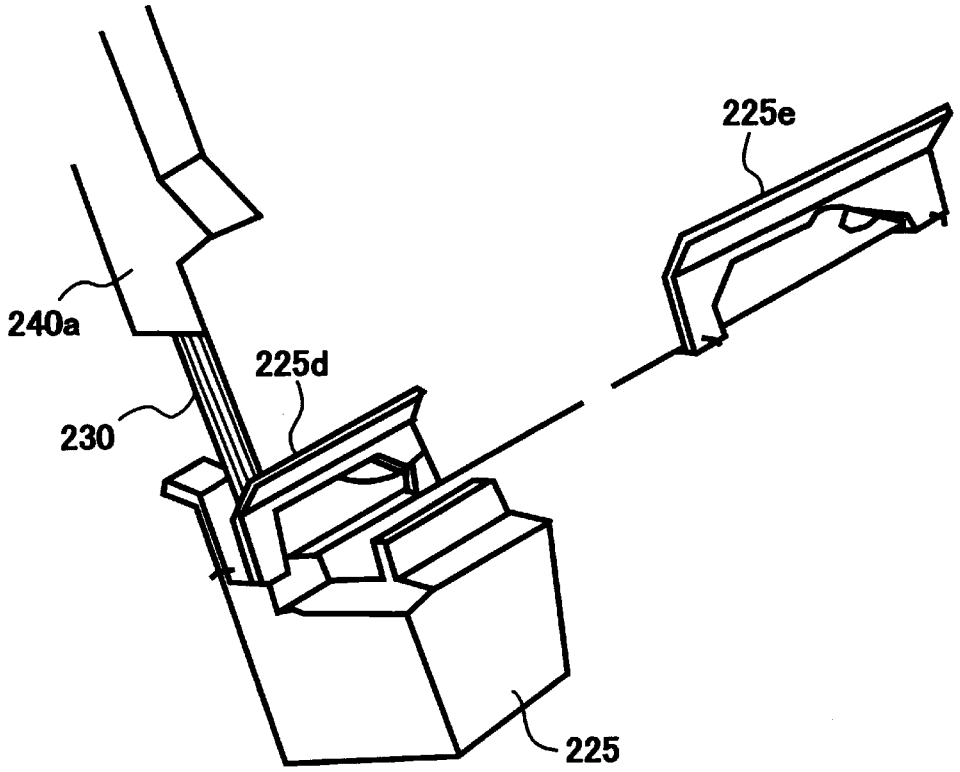
FIGS. 6A through 6C show three possible stapling operations.
Figure 6B:
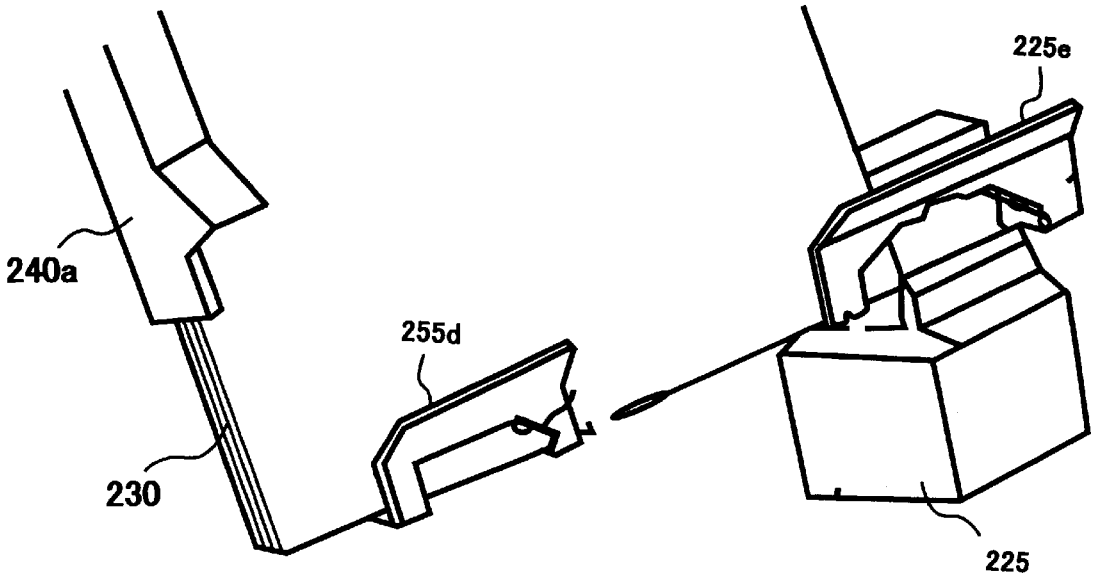
Figure 6C:
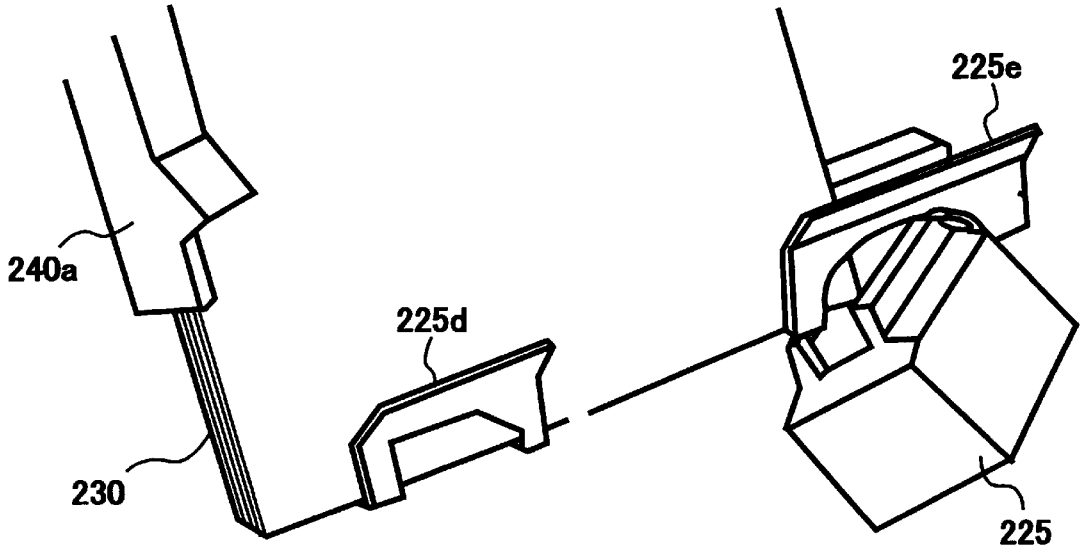

FIGS. 6A–6C show the staple unit 225 positions when the staple unit staples in the top right position, top left position, and top comer slant position, respectively, of the recording sheet 230.

Figure 7:
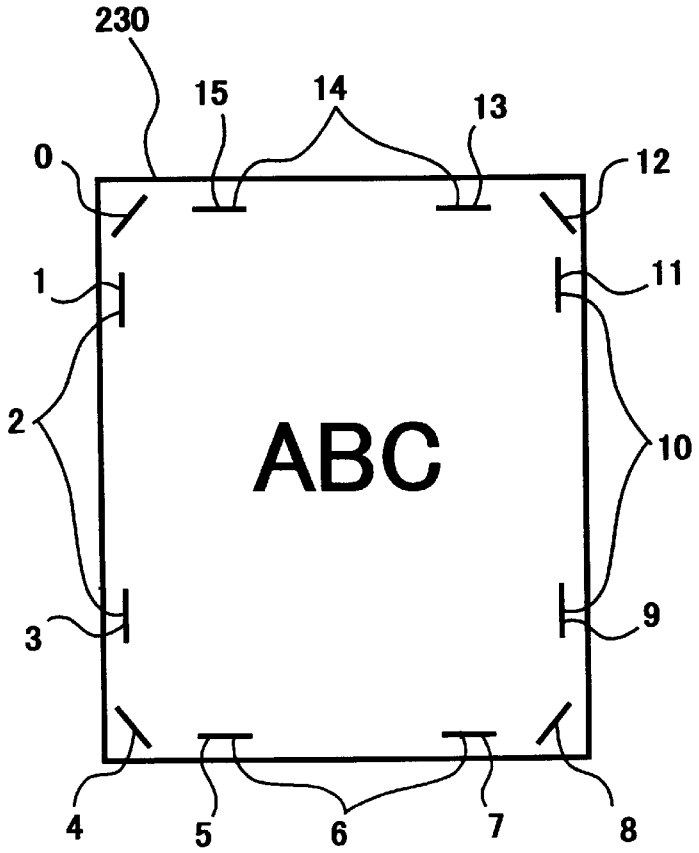
FIG. 7 shows potential stapling patterns on a paper sheet.

More specifically, the staple unit 225 can perform the stapling operation in 15 staple patterns relative to the surface of the recording sheet 230 in a portrait orientation and having the image of ABC, for example as illustrated in FIG. 7. The 15 patterns includes patterns 1, 3, 11, and 9 in which the stapling is performed at one vertical position in left or right side edges of the recording sheet 230. In patterns 15, 13, 5, and 7, the stapling is performed at one horizontal position in either the top or bottom side edges of the recording sheet 230. In patterns 0, 4, 8, and 12, the stapling is performed a slanting position in one of the four corner edges of the recording sheet 230. In pattern 2, the stapling is performed at two vertical positions in the left side edge of the recording sheet 230. In pattern 10, the stapling is performed at two vertical positions in the right side edge of the recording sheet 230. In pattern 14, the staple is performed at two horizontal positions in the top side edge of the recording sheet 230. In pattern 6, the stapling is performed at two horizontal positions in the bottom side edge of the recording sheet 230.

As explained above, both punch and staple functions have selective punch and staple positions, respectively, and can be used in combination. When they are used in combination, however, the punch holes and the staple position need to be performed in the same side of the recording sheet 230. This is because when the punch and staple functions are performed in sides different from each other, the punch holes cannot be used. In the present embodiment, useless combinations are previously eliminated and useful combinations are registered in tables shown in FIGS. 8–11, which arc previously stored in the memory 213 of the image handling controller 210.

Each of the tables of FIGS. 8–11 explains feasibility of staple and punch combinations in which a variety of staple and punch commands are combined in accordance with various parameters such as the 4 punch positions, the 16 staple patterns, the orientations of the print image, the sizes of the recording sheet, the orientation of the recording sheet, and the print method such as a simplex or duplex print.

Specifically, in a duplex print, the orientations of the print image need to be considered since they are differently set from those of the simplex print. For example, in the top side stapling mode, the rear-sided pages may have the top side of the image facing down.

In the tables of FIGS. 8–11, each mark X1 provided in specific matrix positions represents a cancellation of the staple command because of an operational limitation due to the physical configuration of the staple unit 225. That is, the staple command for the specific position is not allowed since the staple unit 225 cannot perform the staple operation due to the physical configuration of the staple unit. Each of values 0 and 180 indicates a rotation angle needed for the recording sheet 230 to be rotated so that staple unit 225 can perform the staple operation at a specified position of the recording sheet 230. Each mark X2 presented in specific matrix positions represents a cancellation of the staple command because of a conflict with the duplex print mode. That is, the staple and/or punch commands are not allowed when a staple pattern commanded has a physical conflict with the staple position required for the duplex print mode. A value inside parentheses presented in the punch parameter row (see the pattern No. 2, for example) indicates an allowable punch operation to be performed together with a specific staple operation in parenthesis as a combination.

The table for the portrait short edge format shown in FIG. 8 represents staple pattern Nos. 1–7. For example, the pattern No. 1 explains whether the staple pattern 0 is allowed or not. More specifically, it indicates by the mark X1 that the command for the staple pattern 0 is not allowed and is cancelled in the simplex print mode and in the top side staple mode and the left side staple mode when in the duplex print mode. Also, the pattern No. 1 indicates by the mark X2 that the command for the staple pattern 0 is not allowed and is cancelled in the right side staple mode in the duplex print mode.

The tables of FIGS. 9–11 are the cases of a landscape short edge, a portrait long edge, and a landscape long edge, respectively. The selective combinations of staple parameters, punch parameters, image orientation, sheet sizes, and sheet transfer orientations, relative to a variety of staple patterns shown in FIGS. 8–11, are previously stored in the memory 213 of the image handling controller 210.

Figure 12:
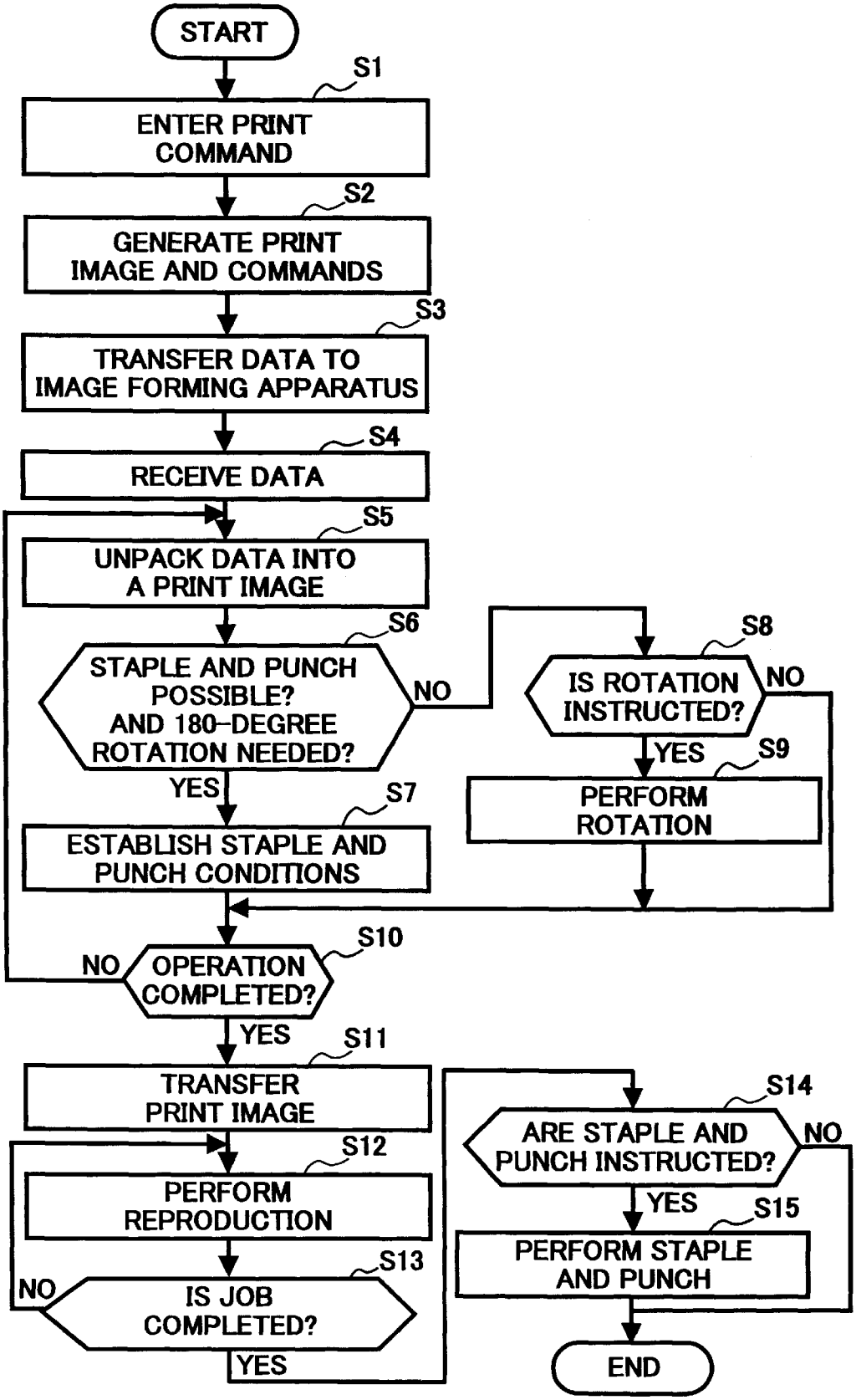
FIG. 12 is a flowchart for explaining an exemplary image forming operation including exemplary staple and punch operations of the image forming apparatus of FIG. 1.

Next, an exemplary operation of the image forming apparatus 200 for reproducing image data sent from the host apparatus 100 will be explained with reference to a flowchart of FIG. 12. The exemplary operation starts when an operator generates a document and/or a figure and enters a print instruction on the host apparatus 100. In Step S1 of FIG. 12, a printer driver of the host apparatus 100 is activated to determine various printing and finish conditions, including the image reproduction orientations, the recording sheet sizes, the staple patterns 0–15, the duplex reproduction, a staple mode of duplex reproduction, and so forth. An instruction of the duplex reproduction and the staple mode of duplex reproduction leads to a determination if the specified staple pattern and/or punch position has a conflict with the staple mode of duplex reproduction. The operation for determining these printing and finish conditions may alternatively be instructed through a specific application program. Upon a completion of specifying these conditions, the printer driver generates image data and commands for the printing and finish conditions based on the information of the document and figure generated by the operator and of the printing and finish conditions determined by the operator in Step S2.

Then, in Step S3, the host apparatus 100 sends the image data and the commands for the various printing and finish conditions to the image forming apparatus 200 through a printer interface (not shown) of the host apparatus 100. In image forming apparatus 200, the host interface 211 receives the image data and the commands for the various printing and finish conditions and sends the image data and the commands to the data unpack unit 212 in Step S4. In data unpack unit 212, the page image generating unit 215 interprets the image data and converts it into print image data in Step S5. Then, the finish command determination unit 216 interprets the commands and compares a specified finish condition, such as the staple pattern, with the information in Tables of FIGS. 8–11, stored in the memory 213, including the reproduction orientations, the recording sheet sizes, the staple patterns, the duplex reproduction, the staple mode of duplex reproduction, and so forth, in combination with instructions, such as a portrait or landscape orientation, with respect to the recording sheets 230 which are actually stored in the recording sheet supply units 222*a*–222*d*. Based on the result of the comparison, the finish command determination unit 216 determines if the staple and punch operations are feasible and if the 180-degree image rotation is required in Step S6.

If the staple or punch operation is feasible, the staple or punch condition is established in Step S7. Also, if the 180-degree image rotation is required, the 180-degree image rotation condition is established in Step S7. When the host apparatus 100 specifies the staple or punch instruction and the rotation sort instruction in establishing these finish conditions, the rotation sort instruction is cancelled since the staple or punch function takes precedence over the rotation sort function, and the rotation sort operation is not compatible with a staple or punch operation. Also, when the staple and punch instructions have a conflict as indicated by X1 in tables of FIGS. 8–11, the staple and punch instructions are cancelled and the rotation sort instruction is established.

If a staple or punch is not required, the finish command determination unit 216 determines, in Step S8, if the rotation sort instruction is specified. If the rotation sort instruction is specified, the finish command determination unit 216 performs the rotation sort instruction in Step S9. Sequential operations through Steps S5–10 are repeated before the entire data is completed.

Upon completion of the sequential operations through Steps S5–10 with respect to the entire data, the data unpack unit 212 sends the print image data generated by the page image generating unit 215 and the commands established by the finish command determination unit 216 to the image forming main controller 221 of the image forming unit 220 in Step S11. The image forming main controller 221 instructs the image forming mechanism 223 to reproduce the print image on a recording sheet transferred from one of the recording sheet supply units 222*a*–222*d*, in Step S12. In Step S13, the image forming main controller 221 determines if all the required pages have been reproduced. Then, in Step S14, the image forming main controller 221 determines if the staple and punch conditions are specified as instructed. In Step S15, the image forming main controller 221 instructs the staple unit 225 of the sheet ejection unit 224 to perform the staple operation in accordance with the specified conditions and the punch unit 226 of the sheet ejection unit 224 to perform the punch operation in accordance with the specified conditions, when the staple and punch conditions are specified as instructed.

In this way, the image forming apparatus 200 according to the embodiment of the present invention cancels the rotation sort operation and performs only the staple or punch operation when receiving the staple or punch instruction and the rotation sort instruction at the same time from the host apparatus 100. Thereby, the image forming apparatus 200 can avoid the erroneous result that the staple or punch operation is performed on different sides of the recording sheets by being rotated by the rotation sort function. Also, the image forming apparatus 200 according to the embodiment of the present invention cancels the staple or punch operation and performs the rotation sort operation when the rotation sort operation is established under the conditions that the staple or punch instruction is cancelled, or when the staple and/or punch instruction has a conflict in performing the operation. Thereby, the image forming apparatus 200 can sort the recording sheets even under the conditions that the staple or punch cannot be performed.

The above embodiment is configured to cancel the staple or punch instruction when the staple or punch instruction creates a conflict, as shown in FIGS. 8–11. Alternatively, the embodiment may be configured to perform the staple operation in the staple mode of duplex reproduction when the specified pattern of the staple or the specified position of the punch has a conflict with the specified pattern of the staple mode of duplex reproduction, or to perform the staple operation when the staple operation has a conflict with the punch operation, with respect to the respective combinations of reproduction orientations for the staple patterns 0–15, recording sheet sizes, and an orientation of the recording sheets, as shown in FIGS. 13–16. That is, the image forming apparatus 200 reselects an appropriate staple and/or punch pattern to perform the staple and/or punch operation when the specified pattern of the staple or the specified position of the punch has a conflict with the specified pattern of the staple mode of duplex reproduction. Thereby, the image forming apparatus 200 can accomplish the copy job without canceling the staple and/or punch operation. Also, the image forming apparatus 200 performs the staple and/or punch operation in accordance with the specified staple pattern when the staple pattern has a conflict with the punch pattern. Thereby, the image forming apparatus 200 can increase the ratio of successful performance of the staple operation.

This invention may be conveniently implemented using a conventional general purpose digital computer programmed according to the teaching of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

This application is based on Japanese patent application No. JPAP10186210 filed in the Japanese Patent Office on Jul. 1, 1998, the entire contents of which are hereby incorporated by reference.

What is claimed as new and is desired to be secured by Letters Patent of the United States is:

1. An image forming apparatus which can record images on recording sheets in one of selected portrait and landscape orientations, comprising:

a plurality of sheet supplying mechanisms which store and supply recording sheets in one of portrait and landscape orientations;

a staple mechanism which can perform a staple operation in one of selected staple patterns on said recording sheet having an image recorded thereon;

a punch mechanism which can perform a punch operation in one of selected punch patterns on said recording sheet having an image recorded thereon; and an image forming controller which controls a reproduction of the image on said recording sheet, a rotation sort operation in which recording sheets are alternately supplied from said sheet supplying mechanisms in the portrait and landscape orientations, and staple and punch operations, according to instructed data, wherein said image forming controller cancels said rotation sort operation and performs said staple operation when both said rotation sort and staple operations are instructed.

2. The image forming apparatus as defined in claim 1, wherein said selected staple patterns include a corner slanting staple, a top side edge staple, a bottom side edge staple, a left side edge staple, and a right side edge staple.

3. The image forming apparatus as defined in claim 1, wherein said image forming controller cancels said rotation sort operation and performs said punch operation when both said rotation sort and punch operations are instructed.

4. The image forming apparatus as defined in claim 1, wherein when one of said staple and punch operations and said rotation sort operation are instructed, said image forming controller performs said rotation sort operation only when said one of said staple and punch operation is cancelled.

5. The image forming apparatus as defined in claim 1, wherein when specified staple patterns for said staple operation and said staple mode of duplex reproduction cause a conflict in positions, said image forming controller reselects from said selected patterns a pattern appropriate for a staple mode of duplex reproduction and performs said staple operation using said reselected staple pattern.

6. The image forming apparatus as defined in claim 1, wherein when a specified staple pattern for said staple mode of duplex reproduction and a specified punch pattern for said punch operation cause a conflict in positions said image forming, said controller reselects a punch pattern appropriate for a staple mode of duplex reproduction and performs said punch operation using said reselected punch pattern.

7. The image forming apparatus as defined in claim 1, wherein when a specified staple pattern for said staple operation and a specified punch pattern for said punch operation cause a conflict in positions, said image forming controller reselects a punch pattern appropriate for a specified staple pattern for said staple operation and performs said staple operation using said specified staple pattern and said punch operation using said reselected punch pattern.

8. A sheet ejection mechanism in an image forming apparatus which can record images on recording sheets in one of selected portrait and landscape orientations, comprising:

a staple mechanism which can perform a staple operation in one of selected staple patterns on said recording sheet having an image recorded thereon;

a punch mechanism which can perform a punch operation in one of selected punch patterns on said recording sheet having an image recorded thereon; and an image forming controller which controls a reproduction of the image on said recording sheet, a rotation sort operation in which recording sheets are alternately supplied in the portrait and landscape orientations, and staple and punch operations, according to instructed data, wherein said image forming controller cancels said rotation sort operation and performs said staple operation when both said rotation sort and staple operations are instructed.

9. The sheet ejection mechanism as defined in claim 8, wherein said selected staple patterns include a corner slanting staple, a top side edge staple, a bottom side edge staple, a left side edge staple, and a right side edge staple.

10. The sheet ejection mechanism as defined in claim 8, wherein said image forming controller cancels said rotation sort operation and performs said punch operation when both said rotation sort and punch operations are instructed.

11. The sheet ejection mechanism as defined in claim 8, wherein when one of said staple and punch operations and said rotation sort operation are instructed, said image forming controller performs said rotation sort operation only when said one of said staple and punch operation is cancelled.

12. The sheet ejection mechanism as defined in claim 8, wherein when specified staple patterns for said staple operation and said staple mode of duplex reproduction cause a conflict in positions, said image forming controller reselects from said selected patterns a pattern appropriate for a staple mode of duplex reproduction and performs said staple operation using said reselected staple pattern.

13. The sheet ejection mechanism as defined in claim 8, wherein when a specified staple pattern for said staple mode of duplex reproduction and a specified punch pattern for said punch operation cause a conflict in positions said image forming, said controller reselects a punch pattern appropriate for a staple mode of duplex reproduction and performs said punch operation using said reselected punch pattern.

14. The sheet ejection mechanism as defined in claim 8, wherein when a specified staple pattern for said staple operation and a specified punch pattern for said punch operation cause a conflict in positions, said image forming controller reselects a punch pattern appropriate for a specified staple pattern for said staple operation and performs said staple operation using said specified staple pattern and said punch operation using said reselected punch pattern.

15. An image forming apparatus which can record images on recording sheets in one of selected portrait and landscape orientations, comprising:

sheet supplying means for storing and supplying recording sheets in one of portrait and landscape orientations;

staple means for performing a staple operation in one of selected staple patterns on said recording sheet having an image recorded thereon;

punch means for performing a punch operation in one of selected punch patterns on said recording sheet having an image recorded thereon; and image forming control means for controlling a reproduction of the image on said recording sheet, a rotation sort operation in which recording sheets are alternately supplied from said sheet supplying mechanisms in the portrait and landscape orientations, and staple and punch operations, according to instructed data, wherein said image forming control means cancels said rotation sort operation and performs said staple operation when both said rotation sort and staple operations are instructed.

16. The image forming apparatus as defined in claim 15, wherein said selected staple patterns include a corner slanting staple, a top side edge staple, a bottom side edge staple, a left side edge staple, and a right side edge staple.

17. The image forming apparatus as defined in claim 15, wherein said image forming control means cancels said rotation sort operation and performs said punch operation when both said rotation sort and punch operations are instructed.

18. The image forming apparatus as defined in claim 15, wherein when one of said staple and punch operations and said rotation sort operation are instructed, said image forming control means performs said rotation sort operation only when said one of said staple and punch operation is cancelled.

19. The image forming apparatus as defined in claim 15, wherein when specified staple patterns for said staple operation and said staple mode of duplex reproduction cause a conflict in positions, said image forming control means reselects from said selected patterns a pattern appropriate for a staple mode of duplex reproduction and performs said staple operation using said reselected staple pattern.

20. The image forming apparatus as defined in claim 15, wherein when a specified staple pattern for said staple mode of duplex reproduction and a specified punch pattern for said punch operation cause a conflict in positions said image forming, said control means reselects a punch pattern appropriate for a staple mode of duplex reproduction and performs said punch operation using said reselected punch pattern.

21. The image forming apparatus as defined in claim 15, wherein when a specified staple pattern for said staple operation and a specified punch pattern for said punch operation cause a conflict in positions, said image forming control means reselects a punch pattern appropriate for a specified staple pattern for said staple operation and performs said staple operation using said specified staple pattern and said punch operation using said reselected punch pattern.

22. An image forming method in a recording apparatus having a controller which instructs finishing steps on recording sheets having images recorded thereon, comprising the steps of:

recording images on the recording sheets;

a rotation sort operation which alternately rotates an orientation of the recording sheet having the image recorded thereon between a portrait orientation and a landscape orientation;

a staple operation which performs stapling in one of selected staple patterns on said recording sheet having an image recorded thereon; and a punch operation which performs a punch in one of selected punch patterns on said recording sheet having an image recorded thereon, wherein said rotation sort operation is cancelled and said staple operation is performed when both said rotation sort and staple operations are instructed.

23. The method as defined in claim 22, wherein said selected staple patterns include a corner slanting staple, a top side edge staple, a bottom side edge staple, a left side edge staple, and a right side edge staple.

24. The method as defined in claim 22, wherein said controller cancels said rotation sort operation and performs said punch operation when both said rotation sort and punch operations are instructed.

25. The method as defined in claim 22, wherein when one of said staple and punch operations and said rotation sort operation are instructed, said controller performs said rotation sort operation only when said one of said staple and punch operation is cancelled.

26. The method as defined in claim 22, wherein when specified staple patterns for said staple operation and said staple mode of duplex reproduction cause a conflict in position, said controller reselects from said selected patterns a pattern appropriate for a staple mode of duplex reproduction and performs said staple operation using said reselected staple pattern.

27. The method as defined in claim 22, wherein when a specified staple pattern for said staple mode of duplex reproduction and a specified punch pattern for said punch operation cause a conflict in positions said image forming, said controller reselects a punch pattern appropriate for a staple mode of duplex reproduction and performs said punch operation using said reselected punch pattern.

28. The method as defined in claim 22, wherein when a specified staple pattern for said staple operation and a specified punch pattern for said punch operation cause a conflict in positions, said controller reselects a punch pattern appropriate for a specified staple pattern for said staple operation and performs said staple operation using said specified staple pattern and said punch operation using said reselected punch pattern.

* * * * *